United States Patent [19]

Katoh et al.

[11] Patent Number: 4,719,491

[45] Date of Patent: Jan. 12, 1988

[54] COPIER

[75] Inventors: Eiichi Katoh, Tokyo; Hiroshi Yasuda, Yokohama, both of Japan

[73] Assignee: Ricoh Company, Ltd., Tokyo, Japan

[21] Appl. No.: 13,425

[22] Filed: Feb. 11, 1987

[30] Foreign Application Priority Data

Feb. 19, 1986 [JP] Japan ..... 61-32902

[51] Int. Cl.[4] ..... G03G 15/00

[52] U.S. Cl. ..... 355/14 R; 355/3 R

[58] Field of Search ..... 355/14 R, 8, 3 R, 11

[56] References Cited

U.S. PATENT DOCUMENTS

| | | | |
|---|---|---|---|
| 4,218,735 | 8/1980 | McCutcheon | 355/14 R |
| 4,391,506 | 7/1983 | Koide | 355/14 R |
| 4,426,149 | 1/1984 | Kuemmel et al. | 355/14 R |
| 4,522,483 | 6/1985 | Matsumoto et al. | 355/14 R |
| 4,561,764 | 12/1985 | Sugiura | 355/14 R |
| 4,582,418 | 4/1986 | Kozuka et al. | 355/14 R |

*Primary Examiner*—R. L. Moses

*Attorney, Agent, or Firm*—Oblon, Fisher, Spivak, McClelland & Maier

[57] ABSTRACT

A copier includes one motor for driving a photoconductive element unit, a developing unit, a fixing unit and other units, and another motor for driving an optical system. A clutch is interposed between the various units and the motor adapted to drive them. A device is provided for uncoupling the clutch for a predetermined period of time to interrupt the transmission of a drive force to the various units. The motor assigned to the units, clutch and drive force interrupting device are controlled such that the drive force interrupting device maintains the clutch uncoupled until the motor reaches a predetermined synchronous rotation speed after the start of rotation so as to interrupt the transmission of the drive force to the load, the clutch being coupled upon the lapse of the predetermined period of time to drive the load.

2 Claims, 6 Drawing Figures

COPIER

BACKGROUND OF THE INVENTION

The present invention relates to a copier and, more particularly, to a copier in which a motor for driving a photoconductive element unit, a developing unit, a fixing unit and other various units and a motor for driving an optical system are installed independently of each other, the motor assigned to the units being comprised of a synchronous motor.

There has been proposed a copier in which a developing unit, a photoconductive element unit, a fixing unit and other units and an optical system are driven by individual DC motors, induction motors, synchronous motors or the like. However, a problem with DC motors is that they are expensive. Induction motors, on the other hand, are apt to slip and are variable in rotation speed depending upon the voltage applied thereto, resulting in a magnification other than a desired one in an intended direction of paper transport.

Synchronous motors are less expensive than DC motors and, at a predetermined frequency, rotatable at a fixed synchronous speed with no regard to the load. For this reason, a synchronous motor is extensively used with various units which are installed in a copier. Nevertheless, a synchronous motor is not fully acceptable when applied to a copier. Specifically, because loads are continuously exerted on a synchronous motor by, for example, the developing unit, photoconductive element unit and fixing unit as soon as the motor is energized, an arrangement has to be so made as to generate a starting moment which is as great as the rated load of the motor. This requirement cannot be met without making the motor and the copier bulky and without entailing temperature elevation inside of the copier.

Further, because a substantial load begins to act on the motor immediately after the start of the motor and because the input fluctuates, the motor becomes settled at a lower rotation speed than a predetermined synchronous speed before reaching the latter. The optical systm, on the other hand, is driven in synchronism with the synchronous speed of a synchronous motor and, therefore, the drive speed of the photoconductive element is lower than that of the optical system. In this condition, an image is somewhat reduced in an intended directin of rotation of the photocondutive element when formed on the element, appearing blurred or otherwise disturbed over the whole area.

SUMMARY OF THE INVENTION

It is therefore an object of the present invention to provide a highly reliable copier capable of producing clear-cut images.

It is another object of the present invention to provide a copier which is small size and low cost.

It is another object of the present invention to provide a generally improved copier.

A copier of the present invention comprises an optical system and a first motor for driving the optical system, various units installed in the copier and a second motor for driving the various units, the second motor comprising a synchronous motor, a clutch interposed between the second motor and a load which is continuously operated by a drive force which is produced by the second motor in one direction, and a drive force interrupting device for interrupting the transmission of the drive force to the load by uncoupling the clutch for a predetermined period of time. The second motor, clutch and drive force interrupting device are controlled such that the drive force interrupting device maintains the clutch uncoupled until the second motor reaches a predetermined synchronous rotation speed after the start of rotation so as to interrupt the transmission of the drive force to the load, the clutch being coupled upon a lapse of the predetermined period of time to drive the load.

The above and other objects, features and advantages of the present invention will become more apparent from the following detailed description taken with the accompanying drawings.

DESCRIPTION OF THE PREFERRED EMBODIMENT

Figure 1:
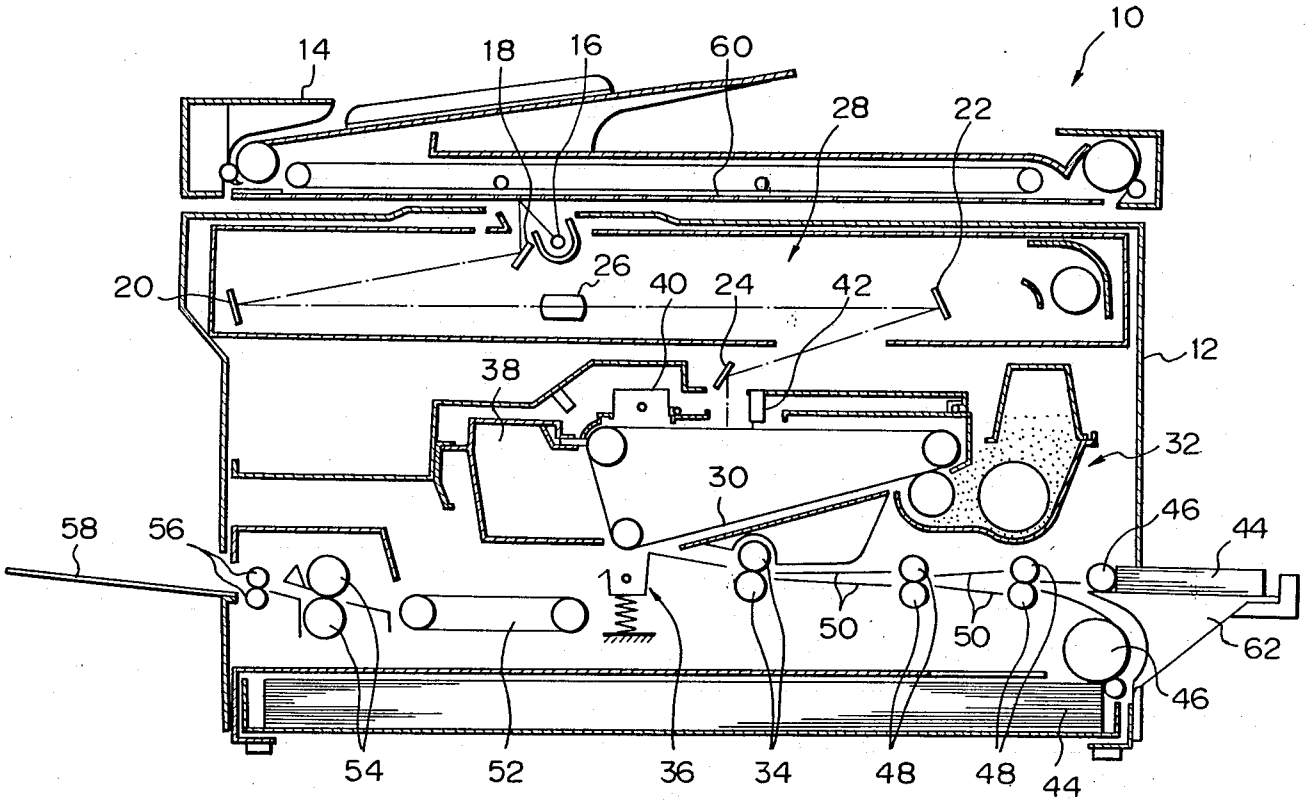
FIG. 1 is a schematic view of a copier embodying the present invention.

Referring to FIG. 1 of the drawings, a copier in accordance with the present invention is shown and generally designated by the reference numeral 10. The copier includes a document carriage which constitutes a part of an optical system. A DC motor is used to drive the optical system and controlled in speed by a servo mechanism. Specifically, the copier 10 has a casing 12 above which a document carriage 14 is disposed to be movable over a predetermined stroke. Located below the carriage 14 are a light source 16, mirrors 18, 20, 22 and 24, and a lens 26 which are fixed in place. The carriage 14, light source 16, mirrors 18, 22 and 24 and lens 26 constitute an optical system 28.

An endless belt 30 which serves as a photoconductive element is provided below the optical system 28 to rotate in a predetermined direction. Arranged at predetermined positions around the belt 30 are a developing unit 32, a pair of register rollers 34, a transfer unit 36, a cleaning unit 38, a charger unit 40, and an erase lamp 42. In FIG. 1, there are also shown a stack of papers 44, feed rollers 46, intermediate rollers 48, paper guides 50, a conveyor belt 52, a pair of fixing rollers 54, a pair of discharge rollers 56, a discharge tray 58, a glass platen 60, and a tray 62 for manual insertion. A copying cycle which the copier 10 performs is the same as that of a prior art copier and, therefore, description thereof will be omitted to avoid redundancy.

Figure 2:
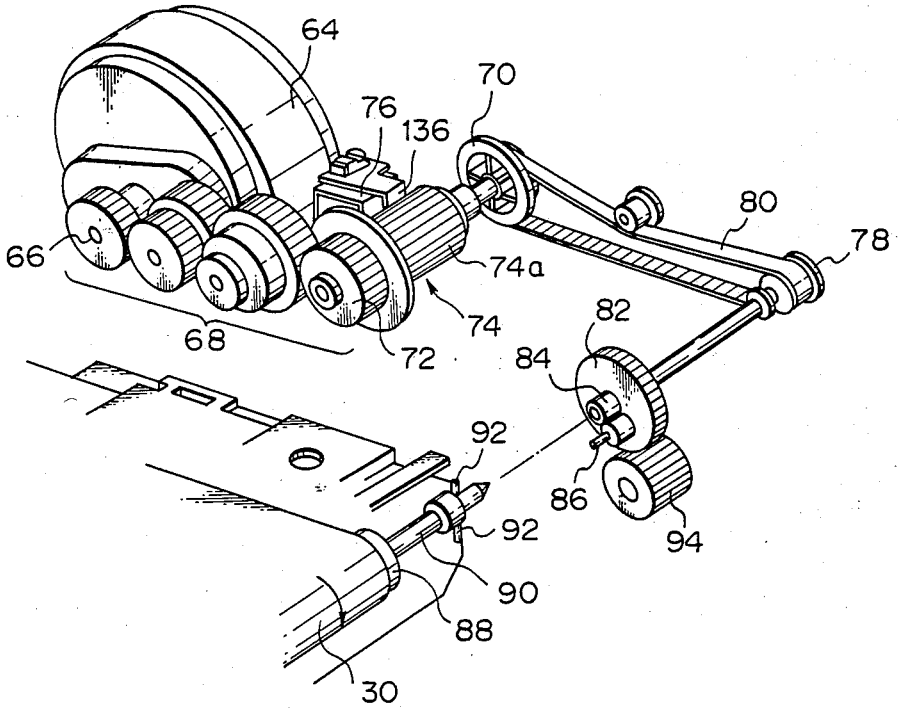
FIG. 2 is a fragmentary perspective view a gearing which is installed in the copier of FIG. 1 for transmitting a drive force.

Referring to FIG. 2, a gearing for transmitting a driving force from a main motor to the photoconductive element unit and developing unit is shown. As shown, a main motor 64 adapted to drive various units of the copier 10 comprises a synchronous motor and has an output shaft 66 which is operatively connected to a drive pulley 70 by a plurality of intermediate gears 68. A spring clutch 74 is interposed between the drive pulley 70 and the last one 72 of the intermediate gears. An electromagnetic solenoid 76 is positioned near the clutch 74 in order to set up and interrupt the transmission of the driving force. A timing belt 80 is passed over the drive pulley 70 and a driven pulley 78 which is spaced a predetermined distance from the drive pulley 70. Provided coaxially with the driven pulley 78 is a gear 82 which serves to drive the photoconductive element unit and developing unit. A hollow stub 84 extends axially from a radially central part of the drive gear 82 while a driven pin 86 extends axially from a position of the drive gear 82 which is offset from the hollow stub 84.

Figure 3:
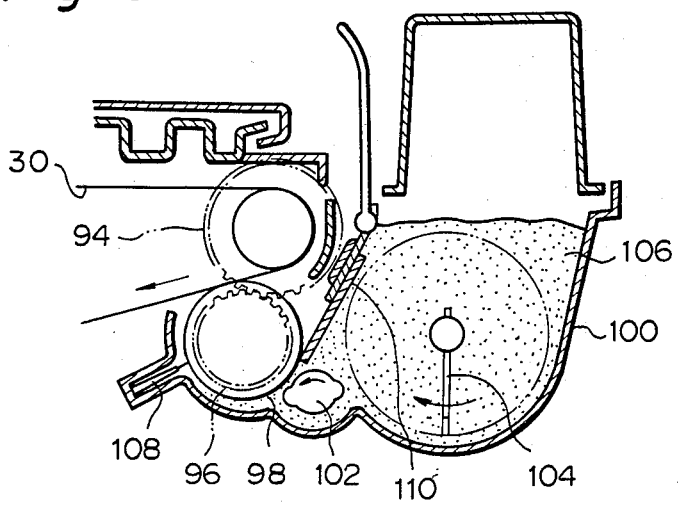
FIG. 3 is a section showing a developing section of the copier of FIG. 1.

The belt 30 is passed over a drive roller 88 at one end thereof. A transmission shaft 90 extends from the drive roller 88 toward the drive gear 82 and has its tip received in the hollow stub 84. Two pins 92 are provided on the shaft 90 to extend radially outwardly away from each other and engageable with the drive pin 86. When the drive pin 86 is engaged with the pins 92, the rotation of the drive gear 82 is transmitted to the drive roller 88 by the shaft 90 to thereby drive the belt 30 in a predetermined direction. A gear 94 is held in mesh with the drive gear 82. As shown in FIG. 3, the gear 94 is operatively connected through an intermediate gear 96 to a developing roller 98. The peripheral surface of the roller 98 is rollably engaged with the surface of the belt 30. A receptacle 100 accommodates therein a toner supply bar 102, an agitator 104, a toner 106, a discharging brush 108 and a developing blade 110 as well as the developing roller 98.

Figure 4:
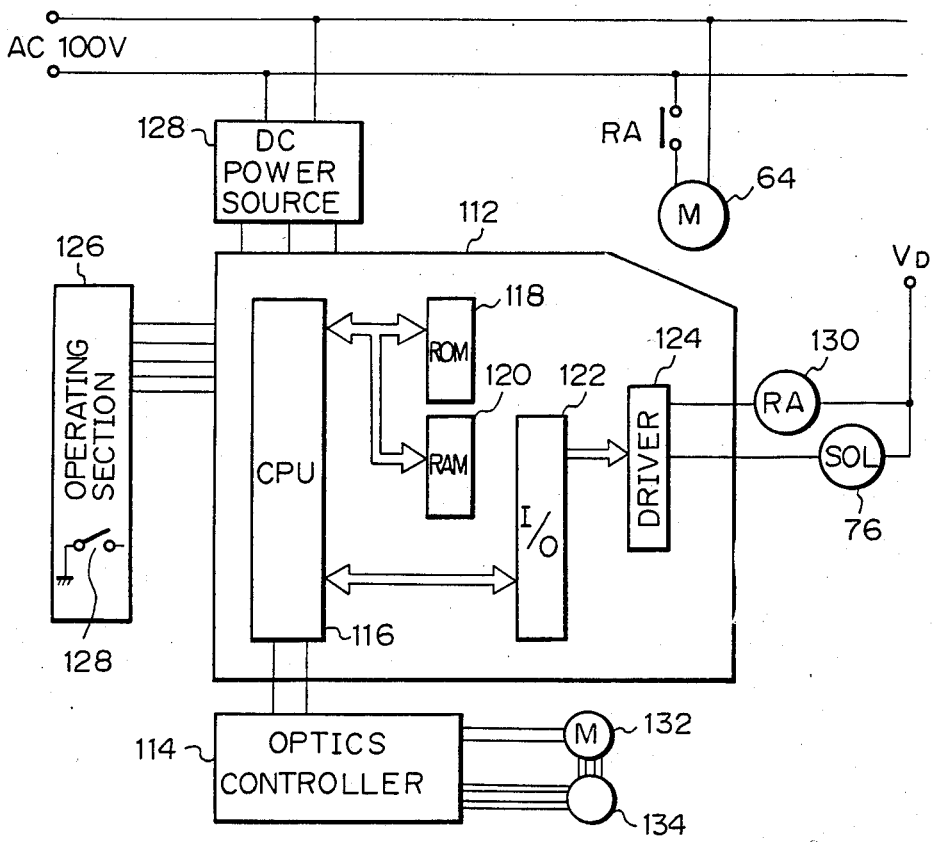
FIG. 4 is a block diagram showing a control system installed in the copier of FIG. 1.

FIG. 4 shows a control section which is incorporated in the copier 10. As shown, the control section is chiefly made up of a main controller 112 adapted to control the various units of the copier 10, and an optics controller 114 adapted to control the optical system 28. The main controller 112 includes a central processing unit (CPU) 116, a read only memory (ROM) 118, a random access memory (RAM) 120, an input/output (I/O) port 122, and a driver 124. Connected to the main controller 112 are an operating section 126, a DC power source 128, a relay (RA) 130 associated with the main motor 64, and the solenoid (SOL) 76. The operating section 126 is provided with a copy start switch 128 and other switches as well as a display. Although not shown in the drawing, the optics controller 114 includes a CPU, a storage implemented with a ROM and a RAM, and an I/O port. Connected to the optics controller 114 are a DC motor 132 for the drive of the optical system, and an encoder 134.

Figure 5:
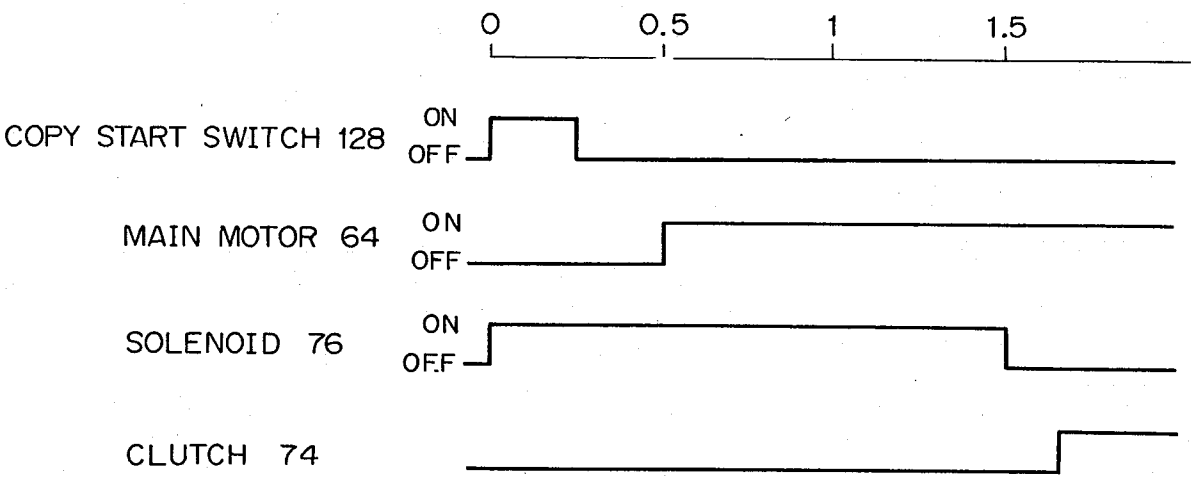
FIG. 5 is a timing chart representative of a relationship between essential sections of the copier of FIG. 1.
Figure 6:
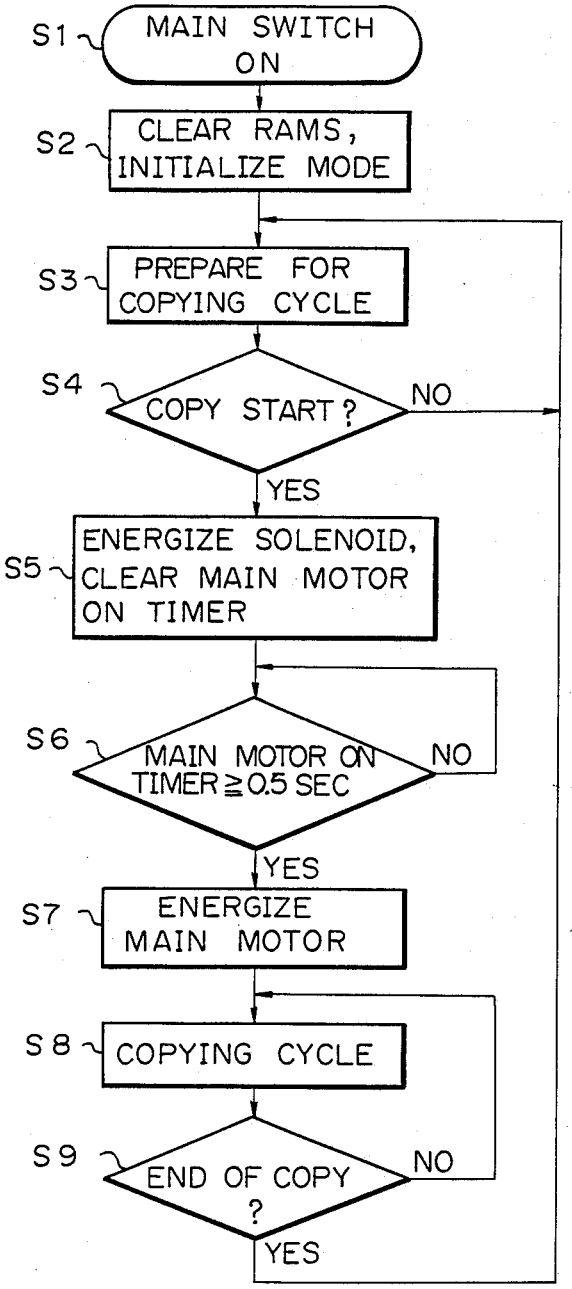
FIG. 6 is a flowchart demonstrating the operation of the copier of FIG. 1.

FIG. 5 shows the operation timings of the copy start switch 128, main motor 64, solenoid 76 and spring clutch 74 of the copier 10. FIG. 6 demonstrates in a flowchart the general control flow of the copier 10. The control of the copier 10 will hereinafter be described with reference to FIGS. 5 and 6.

As shown in FIG. 6, a main switch of the copier 10 is turned on at a step (S) 1. At the next S2, data stored in the RAMS of the control section are cleared while, at the same time, the operation mode is initialized. Then, at S3, preparations for a copying cycle are completed. At S4, the copy start switch 128 of the operating section 126 is depressed so that the control section decides whether or not a copy start signal has been received. If it has been received, the program advances to S5 to energize (ON) the solenoid 76 and clear a main motor ON timer. The solenoid 76 energized magnetically attracts an actuator pawl 136 thereof resulting that the pawl 136 is brought into mesh with any of recesses 74*a*, which are provided on the outer periphery of the spring clutch 74. So long as the actuator pawl 136 is engaged with the recess 74*a*, the spring clutch 74 remains uncoupled and, therefore, cannot transfer the power.

At the subsequent S6 of FIG. 6, the control section determines if a period time of 0.5 second has expired since the turn-on of the copy start switch 128. As soon as 0.5 second expires as mentioned, the control section energizes the main motor 64. The period of time of 0.5 second is long enough for the solenoid 76 to be energized to cause the actuator pawl 136 into mesh with the recess 74*a* and, thereby, uncouple the clutch 74. At S7, the main motor 64 begins to rotate, but it cannot drive the photoconductive element unit and developing unit immediately because the sprng clutch 74 has been uncoupled. As shown in FIG. 5, the solenoid 76 is so controlled as to remain energized for 1.5 seconds after the turn-on of the copy start switch 128. Upon the lapse of the period of time of 1.5 seconds, the solenoid 76 is deenergized so that the actuator pawl 136 and the recess 74*a* are released from each other by a spring member which, although not shown, is built in the solenoid 76. This couples the clutch 74 to set up the power transmission path. Consequently, each of the photoconductive unit and developing unit begins to be driven upon the lapse of approximately 1 second since the start of rotation of the main motor 64. Stated anther way, the main motor 64 is allowed to rotate under a no-load condition for approximately one second after the start of rotation, the rotation speed being substantially linearly increased to reach the synchronous speed within a short period of time.

At S8, a copying cycle which includes charging, exposing, developing, paper feeding, transferring, fixing and discharging is performed. Finally, at S9, the copying operation is terminated.

The drive start timings of, for example, the photoconductive element unit and developing unit as determined by the clutch means may be postponed until those which match the movement of the optical system. Such would increase the service life of a cleaning blade, developing section and other slidable portions usually incorportated in a copier, while cutting down the noise.

Although the embodiment has been shown and described as causing the clutch means to interrupt the power transmission to both of the photoconductive element unit and developing unit, there may alternatively be interrupted the power transmission to, for example, any one of the photoconductive unit, developing unit and fixing unit or to the photoconductive element unit and fixing unit, the developing unit and the fixing unit, or all of the units.

Should the developing unit be driven with the photoconductive element unit held in a halt, the toner in the developing unit would undesirably rub itself against only a part of the photocondutive element. Preferably, therefore, it should at least be the developing unit that is to be stopped by the clutch means.

In summary, in accordance with the present invention, it is needless for a synchronous motor adapted to drive various units of a copier to be provided with a starting moment which is the same as the rated torque. This cuts down the dimensions of the motor to approximately two-thirds of the prior art and, thereby, reduces the overall dimensions and cost of the copier while suppressing temperature elevation inside of the copier. Further, because the power transmission from the motor to loads is not effected until the motor reaches a predetermined synchronous speed, the copier prevents the drive speed of, for example, a photoconductive element from becoming somewhat lower than that of an optical system. Images reproduced by such a copier are free from blurring and others and, therefore, clear-cut.

Various modifications will become possible for those skilled in the art after receiving the teachings of the present disclosure without departing from the scope thereof.

What is claimed is:

1. A copier comprising:

an optical system and a first motor for driving said optical system;

various units installed in said copier and a second motor for driving said various units, said second motor comprising a synchronous motor;

clutch means interposed between said second motor and a load which is continuously operated by a drive force which is produced by said second motor in one direction; and drive force interrupting means for interrupting the transmission of the drive force to said load by uncoupling said clutch means for a predetermined period of time;

said second motor, clutch means and drive force interrupting means being controlled such that said drive force interrupting means maintains said clutch means uncoupled until said second motor reaches a predetermined synchronous rotation speed after a start of rotation so as to interrupt the transmission of the dirve force to said load, said clutch means being coupled upon a lapse of said predetermined period of time to drive said load.

2. A copier as claimed in claim 1, wherein said load comprises at lease one of a photoconductive element unit, a developing unit and a fixing unit.

* * * * *